United States Patent [19]

Akita

[11] Patent Number: 4,704,085

[45] Date of Patent: Nov. 3, 1987

[54] DEODORIZING DEVICE FOR OIL STOVE

[75] Inventor: Kenji Akita, Sakai, Japan

[73] Assignee: Sharp Kabushiki Kaisha, Osaka, Japan

[21] Appl. No.: 923,597

[22] Filed: Oct. 27, 1986

Related U.S. Application Data

[63] Continuation of Ser. No. 863,021, May 24, 1986, Pat. No. 4,639,211, which is a continuation of Ser. No. 655,639, Sep. 28, 1984, abandoned.

[30] Foreign Application Priority Data

Oct. 4, 1983 [JP] Japan ..... 58-186172

[51] Int. Cl.[4] ..... F23N 3/00

[52] U.S. Cl. ..... 431/20; 431/30; 431/121; 126/96

[58] Field of Search ..... 431/3, 20, 30, 304, 431/317, 320, 344, 121, 201, 200, 302; 126/95, 96

[56] References Cited

U.S. PATENT DOCUMENTS 1,359,176 11/1920 Kenworthy ..... 431/121

*Primary Examiner*—Randall L. Green

*Attorney, Agent, or Firm*—Birch, Stewart, Kolasch & Birch

[57] ABSTRACT

A movable wick type oil stove which comprises a wick for absorbing oil to provide a fire at the top of the wick, wick cylinders defining a space for disposing the wick therein means for moving the wick in the vertical direction along the wick cylinders, and a deodorizing device for absorbing or removing gas causing an undesirable smell and produced when the fire at the top of the wick is extinguished by lowering the wick to a predetermined position. The deodorizing device comprises a suction device, a movement-sensing element for sensing the movement of the wick, and a temperature-sensing element for sensing a temperature around the wick.

2 Claims, 7 Drawing Figures

DEODORIZING DEVICE FOR OIL STOVE

This application is a continuation of application Ser. No. 863,021, filed on May 24, 1986, now U.S. Pat. No. 4,639,211, which is a continuation of application Ser. No. 655,639, filed on Sept. 28, 1984, now abandoned.

BACKGROUND OF THE INVENTION

The present invention relates to a deodorizing device for a movable wick type oil stove and, more particularly, to a deodorizing device for a movable wick type oil stove for absorbing and removing an incomplete combustion gas or an unburned gas.

In the conventional movable wick type oil stove, the downward movement of the wick stops the evaporation of oil and the supply of air to thereby extinguish the fire at the top of the wick. However, the top of the wick is slightly or palely on fire even after the extinguishment of the fire at the top of the wick has been initiated, so that incomplete combustion gas may be inevitably generated for several seconds to several tens of seconds. After the fired top of the wick is perfectly extinguished, an unburned gas may be generated until the peripherals of inner and outer wick cylinders are completely cooled down. Accordingly, obnoxious and nasty smells are emitted by passing the incomplete combustion gas and the unburned gas through an uncooled burner. However, the conventional oil stove cannot remove the obnoxious and nasty smells, and further, cannot remove the incomplete combustion gas and the unburned gas causing the smell. Therefore, it is desired that a deodorizing device for a moveable wick type oil stove be provided to enable the removal of the obnoxious and nasty smell emitted from the incomplete combustion gas or the unburned gas.

SUMMARY OF THE INVENTION

Accordingly, it is an object of the present invention to provide a deodrizing device in a movable wick type oil stove for absorbing or removing a gas causing obnoxious and nasty smell, the gas being produced by extinguishing the fire at the top of a wick for the movable wick type oil stove.

It is another object of the present invention to provide a deodorizing device for absorbing an incomplete combustion gas or an unburned gas, which may produce an obnoxious and nasty smell by passing the gas through burner at a high temperature when extinguishing the fire at the top of a wick for a movable wick type oil stove.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to an embodiment of the present invention, a movable wick type oil stove comprises wick means for absorbing oil so as to provide a fire at the top of the wick means, wick cylinder means for disposing a wick means in the space formed between the wick cylinder means, the wick means moving in the vertical direction among the wick cylinder means, and deodorizing means for absorbing or removing the gas causing the smell produced when the fire at the top of the wick means is extinguished by moving it down to a predetermined position. The deodorizing means comprises suction means, movement-sensing means for sensing the movement of the wick means, and temperature-sensing means for sensing a temperature around the wick means.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
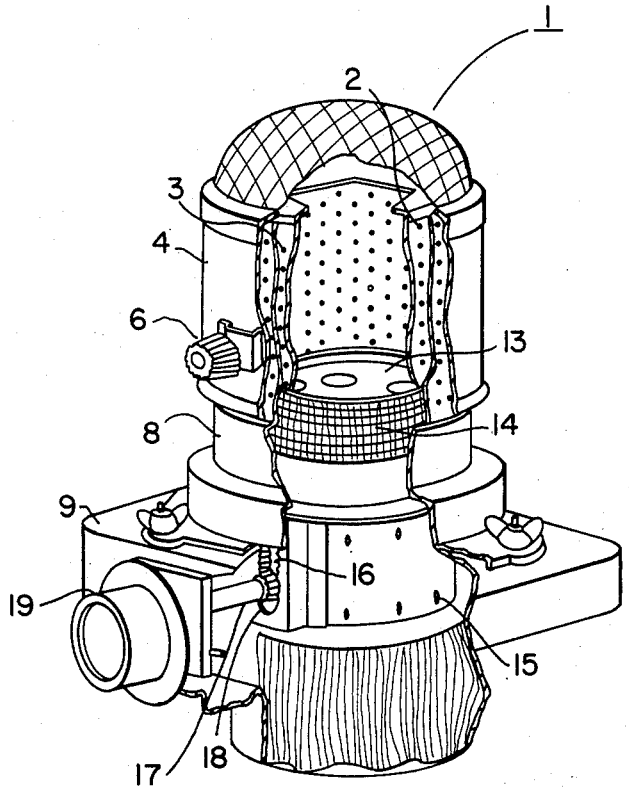
FIG. 1 shows a perspective view, partially broken away, of an essential part of the movable wick type oil stove of the present invention.

A movable wick type stove will be described below. A deodorizing device according to a preferred embodiment of the present invention is applied to movable wick type oil stoves, including the oil stove as shown in FIG. 1.

A burner 1 generally includes an inner shell 2, an outer shell 3 and a cylindrical casing 4, all coaxially disposed with respect to each other with a cross pin (not shown), a buner handle 6, and a perforated bottom plate, etc. An outer wick cylinder 8 is seated on a fuel container 9. An inner wick cylinder (not shown) has an upper end facing inwardly to constitute a burner mounting flange. A wick top plate 13 is positioned at the upper end portion of the inner wick cylinder. The wick top plate 13 serves as the perforated bottom plate for controlling the supply of air to the fire at the top of the wick from the inner wick cylinder.

The burner 1 is disposed on the burner mounting flange of the inner wick cylinder. A combustion wick 14 is movably held in the vertical direction within the outer and inner wick cylinders with its lowest end being dipped into oil in the oil container 9. It is evident that the stove is adapted for use with paraffin, kerosene or other liquid fuels (referred to generally as "oil" hereafter).

A cylindrical wick holder 15 has an elongated rack 16 disposed at a portion of its perphery to enable the wick 14 to move up and down. The rack 16 meshes with a pinion 18 at the end of a wick adjusting shaft 17. Revolution of the wick adjust knob 19 secured at the other end of the shaft 17 enables the wick to be raised and lowered through the wick holder 15.

Figure 2:
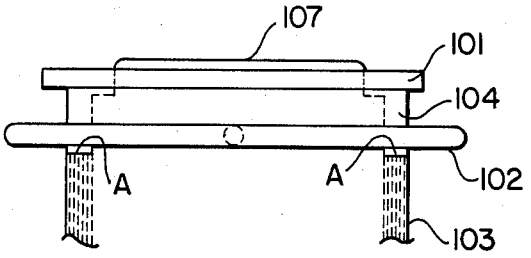
FIG. 2 shows a side view of an outer wick cylinder attached to an absorbing pipe for a deodorizing device according to an embodiment of the present invention.
Figure 3:
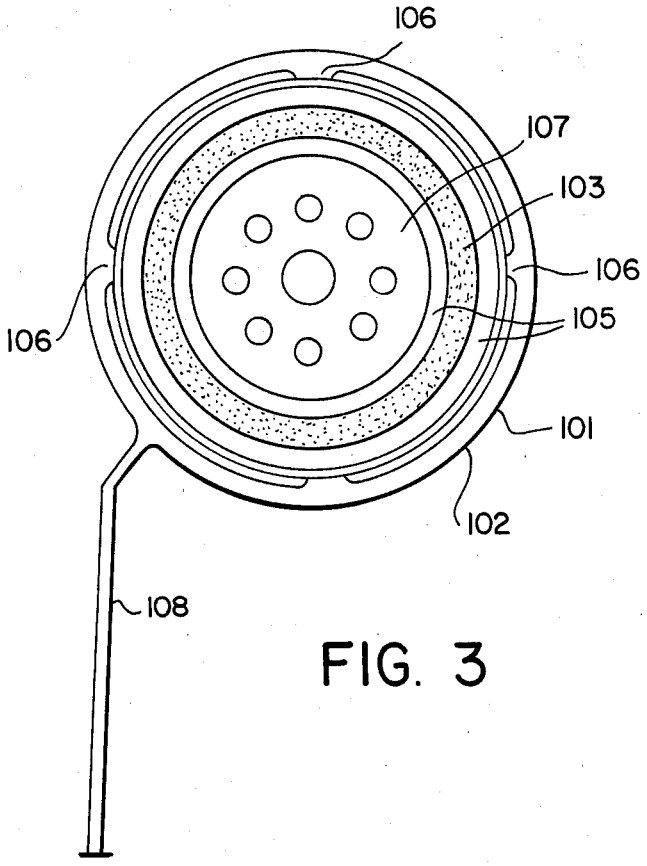
FIG. 3 shows a plan view of FIG. 2.

FIG. 2 shows a side view of an outer wick cylinder attached to an absorbing pipe for producing the deodorizing device according to an embodiment of the present invention. FIG. 3 shows a plan view of FIG. 2.

A wick 103 for a movable wick type oil stove is held movable in the vertical direction within the inner and outter wick cylinders 101 and 104 with its lowest end being dipped into oil in the oil container 9 so as to absorb oil which moves in the upward direction within the wick 103 by using capillar action. A burner assembly is disposed on seat portions 105 of the upper portions of the inner and outer wick cylinders 101 and 104. When the oil stove is fired, the top of the wick 103 projects from the burner seat portions 105, so that the top of the wick 103 is fired by evaporating the absobed oil from the surface of the projected wick. When the fire at the top of the wick 103 is extinguished, the fired top of the wick 103 is moved down by the portion A and the supply of air to the fired top of the wick 103 is thus intercepted. Also, the evaporation of oil occurs only at the brim surface of the top end of the wick 103. Therefore, the fire at the top of the wick 103 is gradually extinguished.

Even when the top of the wick 103 is moved down by to the position A, the incomplete combustion gas or the unburned gas is produced from the slight or pale fire at the top of the wick 103 on the condition that the outer and the inner wick cylinders 101 and 104 are uncooled. According to the present invention, to remove the incomplete combustion gas or the unburned gas, when the flame is extinguished, a ring-like suction pipe 102 is disposed above the top of the wick 103 and extends around the circumference of the outer wick cylinder 104. The ring-like suction pipe 102 communicates with the space formed between the outer and the inner wick cylinders 101 and 104 through communicating tubes 106. The wick 103 is moved down and up in the space formed between the outer and the inner wick cylinders 101 and 104. Therefore, the incomplete combustion gas or the unburned gas, which is produced from the fire at the top of the wick 103 disposed in the space between the outer and the inner wick cylinder 101 and 104, is introduced into the ring-like suction pipe 102 through the communicating tubes 106. The communicating tubes 106 serve to secure the ring-like suction pipe 102 on the surface of the outer wick cylinder 101. The sectional shape of the suction pipe 102 may be formed in a semicircular shape. If the suction pipe 102 is in a semicircular shape, the diameter line surface of the semicircular suction pipe may be directly connected with the circumference surface of the outer wick cylinder 101 with communicating holes for connecting the ring-like suction pipe 102 to the space between the cylinders 101 and 104. Accordingly, if the ring-like suction pipe 102 is directly connected with the circumference surface of the outer wick cylinder 101, the communicating tubes 106 may be eliminated.

If the incomplete combustion gas or the unburned gas is produced from the fire at the top of the wick 103, lowered by a distance A, the incomplete combustion gas or the unburned gas is introduced into the suction pipe 102 through the communicating tubes 106 or the communicating holes so as to be absorbed.

Figure 4:
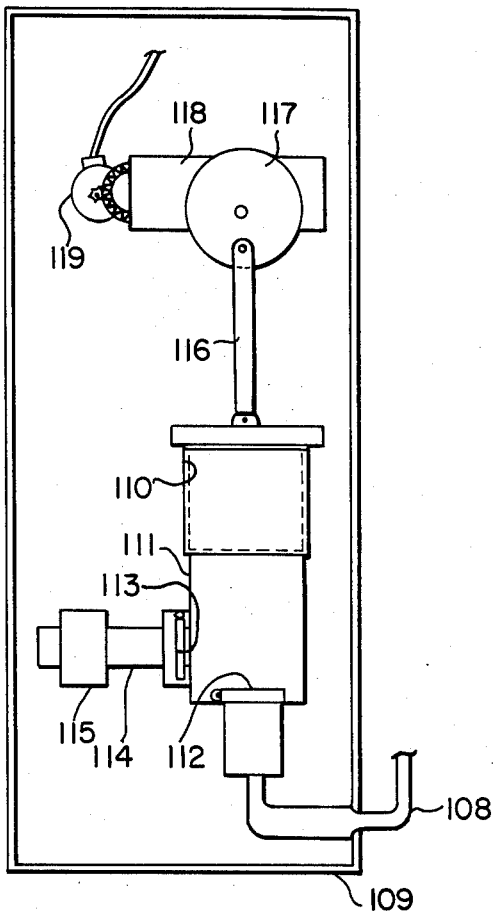
FIG. 4 shows a view of a suction device for the deodorizing device according to the embodiment of the present invention.

A suction device 109 for absorbing the incomplete combustion gas or the unburned gas by connecting with the suction pipe 102 will be described with reference to FIG. 4. The suction pipe 102 and the suction device 109 are connected to each other through a connecting pipe 108. The suction device 109 comprises a pistion 110, a cylinder 111, a suction valve 112 positioned in the cylinder 111, and exhaust valve 113 positioned in the cylinder 111, an exhaust pipe 114, an activated charcol filter 119 for absorbing the obnoxious and nasty smell, an arm 116 and a rotation plate 117 for reciprocating the piston 110, a driving motor 119, and a gear box 118 for increasing the torque power by decreasing the rotation of the driving motor 119 in order to communicate the rotation power to the rotation plate 117.

Figure 5:
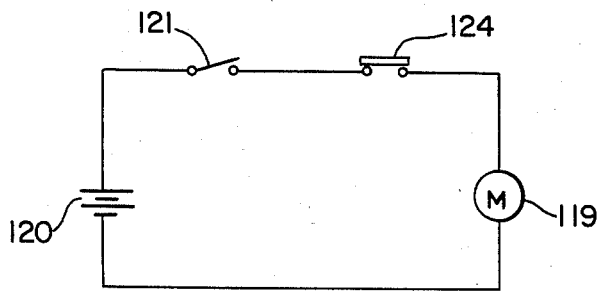
FIG. 5 shows a circuit diagram of the deodorizing device according to the present invention.
Figure 6A:
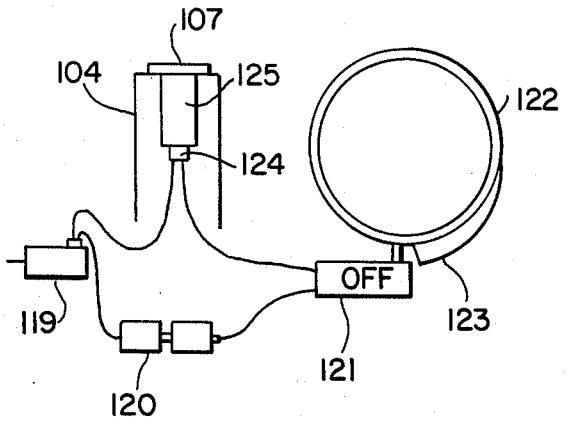
FIGS. 6(A) and 6(B) show drawings of explaining the operation of the deodorizing device of the present invention.
Figure 6B:
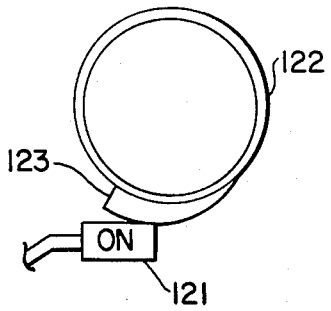

An electrical circuit diagram for the deodrizing device according to an embodiment of the present invention will be described with reference to FIGS. 5, 6(A) and 6(B).

A power source 120 such as a battery is applied to the driving motor 119 for driving the deodorizing device. The power source 120 may be served by a battery for automatically igniting the top of the wick for the movable wick type oil stove. The power source 120 may be commercial power. A switch 121 is operated by communicating with a device for moving the wick 103 in the vertical direction. In the embodiment of the present invention, a cam 123 disposed at the circumference of a wick position control knob 122 in the wick moving device operates the switch 121 such as a microswitch or the like attached to the the main body of the oil stove.

The switch 121 is placed at an "OFF" position when the wick control knob 122 is positioned at a position for fairing the top of the wick. If the wick knob 122 is placed at the position for extinguishing the fire of the top of the wick, the switch 121 is placed at an "ON" position. A heat-responsive switch is designated by element, and in an embodiment of the present invention, a bimetal thermostat serving as the heat-responsive switch 124 is disposed at the bottom position of a heat conductor 125 positioned at the rear surface of the top wick plate 107 by spot soldering or caulking. The heat conductor 125 serves to decrease the operation temperature of the bimetal thermostat, so that, if unnecessary, the heat conductor 125 may be deleted. If the operation temperature of the bimetal thermostat is high, the bimetal thermostat is expensive and lead lines for the bimetal thermostat must be protected from a high temperature.

The heat-responsive switch 124 such as the bimetal thermostat is placed at the "OFF" position at a predetermined temperature (for example, about 40 degrees C.) or more. If the temperature is less than the predetermined temperature, the heat-responsive switch 124 is placed at the "ON" position. Next, the operational principle of the deodorizing device according to an embodiment of the present invention will be described below.

The wick position control knob 122 of the wick moving device is placed at the firing postion while the oil stove is fired. As shown in FIG. 6(A), the driving motor 119 is not driven and the deodorizing device is not operated because the microswitch 121 which communicates with the wick moving device is placed at the "OFF" position. The heat-responsive switch 124 is placed at the "ON" position while the oil stove is fired and the temperature around the microswitch 121 is over about 40 degrees C.

If the top of the wick 103 is moved down to the extent of distance A to thereby operate the extinguishment lever and a movement sensing device, the wick control knob 122 is rotated in the left direction. Accordingly, as shown in FIG. 6(B), the microswitch 121 for switching by communicating with the wick moving device is placed at the "ON" position by the rotation of the cam 123, so that the driving motor 119 is driven and the piston 110 is reciprocated with the rotation power of the driving motor 119 through the rotation plate 117 and the arm 116 forming a linkage system.

When the piston 10 of FIG. 3 is moved up, the sunction valve 112 is opened, so that the incomplete combustion gas or the unburned gas produced from the upper surface of the wick 103 between the outer and the inner wick cylinders 101 and 104 is introduced into the cylinder 111 through the communicating tubes 106, the suction pipe 102 attached to the upper portion around the circumfereance of the outer wick cylinder 101, and the connecting pipe 108 without passing the burner. On the contrary, when the piston 110 is moved down from the upper portion, the suction valve 112 is closed and the exhaust valve 113 is opened, so that the incomplete combustion gas or the unburned gas is exhausted into the room or the outside through the exhaust pipe 114 and the activated charcol filter 115.

If the incomplete combustion gas or the unburned gas is not baked in the uncooled burner, the remarkable obnoxious and nasty smell is not produced.

After the incomplete combustion gas or the unburned gas is introduced to the pipe 102 from the space between the outer and the inner wick cylinders 101 and 104 through the communicating tubes 106, the incomplete combustion gas or the burned gas is cooled through the connecting pipe 108 and the cooled incomplete combustion gas or the unburned gas is absorbed into the cylinder 111 and the incomplete combustion gas or the unburned gas is liquefied in the cylinder 111, so that the obnoxious and nasty smell is not produced from the liquified incomplete combustion gas or the liquified unburned gas. If unecessary, the activated charcoal filter 115 is not disposed in the exhaust pipe 114.

When the slight or pale fire of the top of the wick 103 is perfectly extinguished and the temperature of the outer and the inner wick cylinders 101 and 104 and the top wick plate 107 are decreased, the incomplete combustion gas or the unburned gas is rarely produced. At this time, the bimetal thermostat, as the heat-responsive switch 124 is placed at the "OFF" position less than the predetermined temperature, so that the deodorizing device according to am embodiment of the present invention is stopped from operating.

When the oil stove is ignited, the wick control knob 122 is rotated in the right direction and the switch 122 which communicates with the wick moving device is placed at the "OFF" position. The fire of the oil stove is continued on the condition that the deodorizing device is stopped from operating. After the temperature of the wick top plate 107 is increased and the heat driving switch is placed at the "ON" position, the next fire extinguishment waits.

By absorbing and removing the unburned gas, the extingushment of the fire is quickly completed, and total unburned gas causing the obnoxious smell is descreased.

The oil stove is not limited to the movable wick type oil stove. The deodorizing device according to the present invention may be applied to various oil stoves.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A moveable wick-type oil stove containing an outer wick cylinder means and an inner wick cylinder means, said outer and inner cylinder means defining a space therebetween, wick means for absorbing oil and creating a fire at the top thereof, said wick means being disposed within said space formed between said cylinder means, means for moving the wick means in the vertical direction along the cylinder means, and deodorizing means operatively associated with the wick means for absorbing or removing gas and the associated smell produced when the fire at the top of the wick means is extinguished by lowering the wick to a predetermined position, said deodorizing means including suction means and movement-sensing means for sensing the movement of the wick means, and said movement-sensing means operatively associated with the suction means for activating the suction means in response to the lowering of the wick.

2. The moveable wick-type oil stove of claim 1, wherein said deodorizing means includes temperature-sensing means for sensing a temperature around the wick means, said temperature-sensing means is operatively associated with the suction means in response to the lowering of the wick means, and the suction means is actuated if the temperature sensed by the temperature-sensing means does not fall below a predetermined value.

* * * * *